US009404367B2

(12) United States Patent
Muscat et al.

(10) Patent No.: US 9,404,367 B2
(45) Date of Patent: Aug. 2, 2016

(54) GAS TURBINE ENGINE COMPRESSOR ROTOR ASSEMBLY AND BALANCING SYSTEM

(71) Applicant: Solar Turbines Incorporated, San Diego, CA (US)

(72) Inventors: Cory Patrick Muscat, Poway, CA (US); Laura Elizabeth McDonald, San Diego, CA (US); James Eric Miller, El Cajon, CA (US); Gary Paul Vavrek, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 908 days.

(21) Appl. No.: 13/684,056

(22) Filed: Nov. 21, 2012

(65) Prior Publication Data

US 2014/0140849 A1 May 22, 2014

(51) Int. Cl.

| | |
|---|---|
| ***F01D 5/02*** | (2006.01) |
| ***F01D 5/06*** | (2006.01) |
| ***F01D 5/30*** | (2006.01) |

(52) U.S. Cl.

CPC *F01D 5/027* (2013.01); *F01D 5/06* (2013.01); *F01D 5/3015* (2013.01); *F01D 5/3038* (2013.01)

(58) Field of Classification Search

CPC ..... F01D 5/027; F01D 5/06; F01D 5/3038; F01D 5/3015; F01D 5/02; F01D 5/063; F01D 5/10; F01D 5/30; F01D 2260/96; F01D 2230/60; F16F 15/34

See application file for complete search history.

(56) References Cited

U.S. PATENT DOCUMENTS

| | | | | |
|---|---|---|---|---|
| 3,778,191 | A * | 12/1973 | Brockmann | F01D 5/32 416/215 |
| 3,888,601 | A * | 6/1975 | Glassburn | F01D 5/027 416/144 |
| 4,477,226 | A * | 10/1984 | Carreno | F01D 5/027 416/144 |
| 4,716,761 | A * | 1/1988 | Ito | F01D 5/027 416/145 |
| 4,743,165 | A * | 5/1988 | Ulrich | F01D 5/063 219/118 |
| 4,767,272 | A * | 8/1988 | Kildea | F01D 5/027 29/889.21 |
| 6,422,809 | B1 | 7/2002 | Filippov et al. | |

(Continued)

FOREIGN PATENT DOCUMENTS

| | | |
|---|---|---|
| FR | 2358545 | 2/1978 |
| GB | 1500575 | 2/1978 |

*Primary Examiner* — Richard Edgar
*Assistant Examiner* — Eldon Brockman
(74) *Attorney, Agent, or Firm* — Procopio, Cory, Hargreaves & Savitch LLP

(57) ABSTRACT

A method for balancing a compressor rotor assembly including a forward weldment (211) and an aft weldment (212) includes pre-balancing the aft weldment (212) of the compressor rotor assembly (210) with compressor disks (220) prior to populating the compressor disks (220) with circumferentially installed compressor rotor blades (230). Pre-balancing the aft weldment (212) includes measuring a rotational balance of the aft weldment (212). Pre-balancing the aft weldment (212) also includes determining a number of underplatform weights (260) needed and a location for each underplatform weight (260) within a circumferential slot (236) of one the compressor disks (220). Pre-balancing the aft weldment (212) further includes mounting each underplatform weight (260) in the determined location.

19 Claims, 8 Drawing Sheets

(56) References Cited

U.S. PATENT DOCUMENTS

| | | | | |
|---|---|---|---|---|
| 6,908,285 | B2 * | 6/2005 | Henning | F01D 5/027 29/889.21 |
| 7,753,651 | B2 * | 7/2010 | Dezouche | F01D 5/027 416/145 |
| 8,070,445 | B2 | 12/2011 | Blanchard et al. | |
| 8,342,804 | B2 * | 1/2013 | Pronovost | F01D 5/027 416/144 |
| 9,163,513 | B2 * | 10/2015 | Bestwick | F01D 5/027 |
| 9,260,977 | B2 * | 2/2016 | Milner | F16F 15/34 |
| 2004/0202544 | A1 * | 10/2004 | Henning | F01D 5/027 416/219 R |
| 2005/0265846 | A1 * | 12/2005 | Przytulski | F01D 5/027 416/144 |
| 2008/0152498 | A1 * | 6/2008 | Mollmann | F01D 5/027 416/144 |
| 2009/0123282 | A1 * | 5/2009 | Buskirk | F16F 15/34 416/1 |
| 2010/0080705 | A1 * | 4/2010 | Pronovost | F01D 5/027 416/144 |
| 2010/0135774 | A1 * | 6/2010 | Dezouche | F01D 5/027 415/119 |
| 2010/0278634 | A1 | 11/2010 | Koza et al. | |
| 2010/0296937 | A1 * | 11/2010 | Bestwick | F01D 5/027 416/219 R |
| 2010/0316496 | A1 | 12/2010 | Williams et al. | |
| 2011/0314909 | A1 * | 12/2011 | Harrison | F01D 5/027 73/455 |

* cited by examiner

GAS TURBINE ENGINE COMPRESSOR ROTOR ASSEMBLY AND BALANCING SYSTEM

TECHNICAL FIELD

The present disclosure generally pertains to gas turbine engines, and is more particularly directed toward a gas turbine engine compressor rotor assembly with a balancing system.

BACKGROUND

Gas turbine engines include compressor, combustor, and turbine sections. Rotating components of the gas turbine engine may need to be balanced due to limitations in component manufacturing. In particular the compressor rotor assembly may need to be balanced to reduce vibrations in the gas turbine engine. Larger compressor rotor assemblies may use a dynamic balancing system and method for balancing to reduce vibration and increase component reliability.

US Publication No. 2010135774, to Dezouche, discloses the balancing flyweights of a turbomachine rotor includes two pyramid shaped end parts each one having a base and an apex, and an intermediate part which connects the two bases of the end parts together. The two apexes are aligned on a longitudinal axis. The two end parts and the intermediate part exhibit, in cross section through a plane perpendicular to the longitudinal axis, cross-sections having polygonal shapes centered on said longitudinal axis.

The present disclosure is directed toward overcoming one or more of the problems discovered by the inventors.

SUMMARY OF THE DISCLOSURE

A method for balancing a compressor rotor assembly including a forward weldment and an aft weldment is disclosed. The method includes pre-balancing the aft weldment of the compressor rotor assembly with compressor disks prior to populating the compressor disks with circumferentially installed compressor rotor blades. Pre-balancing the aft weldment includes measuring a rotational balance of the aft weldment. Pre-balancing the aft weldment also includes determining a number of underplatform weights needed and a location for each underplatform weight within a circumferential slot of one the compressor disks. Pre-balancing the aft weldment further includes mounting each underplatform weight in the determined location.

A gas turbine engine compressor rotor assembly with a balancing system includes a first stage compressor disk, a plurality of compressor disks, forward weights, and a plurality of underplatform weights. The first stage compressor disk has a cylindrical body. The first stage compressor disk includes a plurality of forward balancing holes circumferentially about the cylindrical body. The first stage compressor disk also includes a plurality of aft balancing holes circumferentially about the cylindrical body and located adjacent to the plurality of forward balancing holes. Each of the compressor disks includes a circumferential slot. Each circumferential slot includes a dovetail profile. Forward weights are configured to be installed in the plurality of forward balancing holes and the plurality of aft balancing holes. Each underplatform weight is configured to be installed within one or more of each of the circumferential slots. Each underplatform weight has a dovetail shape corresponding to the circumferential slot dovetail profile of one or more of the plurality of compressor disks. The plurality of underplatform weights includes two or more sizes.

DETAILED DESCRIPTION

The systems and methods disclosed herein include a gas turbine engine compressor rotor assembly with a balancing system. In embodiments, the compressor rotor assembly includes a forward weldment, an aft weldment, and a balancing system. The balancing system includes forward weights and underplatform weights. The forward weights may be installed into one of two rows of balancing holes, which may provide for a quicker and more accurate balancing of the forward weldment or the compressor rotor assembly. The underplatform weights may be installed between any circumferentially installed compressor rotor blades of the compressor rotor assembly, which may provide the ability to pre-balance the aft weldment and may provide for a quicker and more accurate balancing of the compressor rotor assembly.

Figure 1:
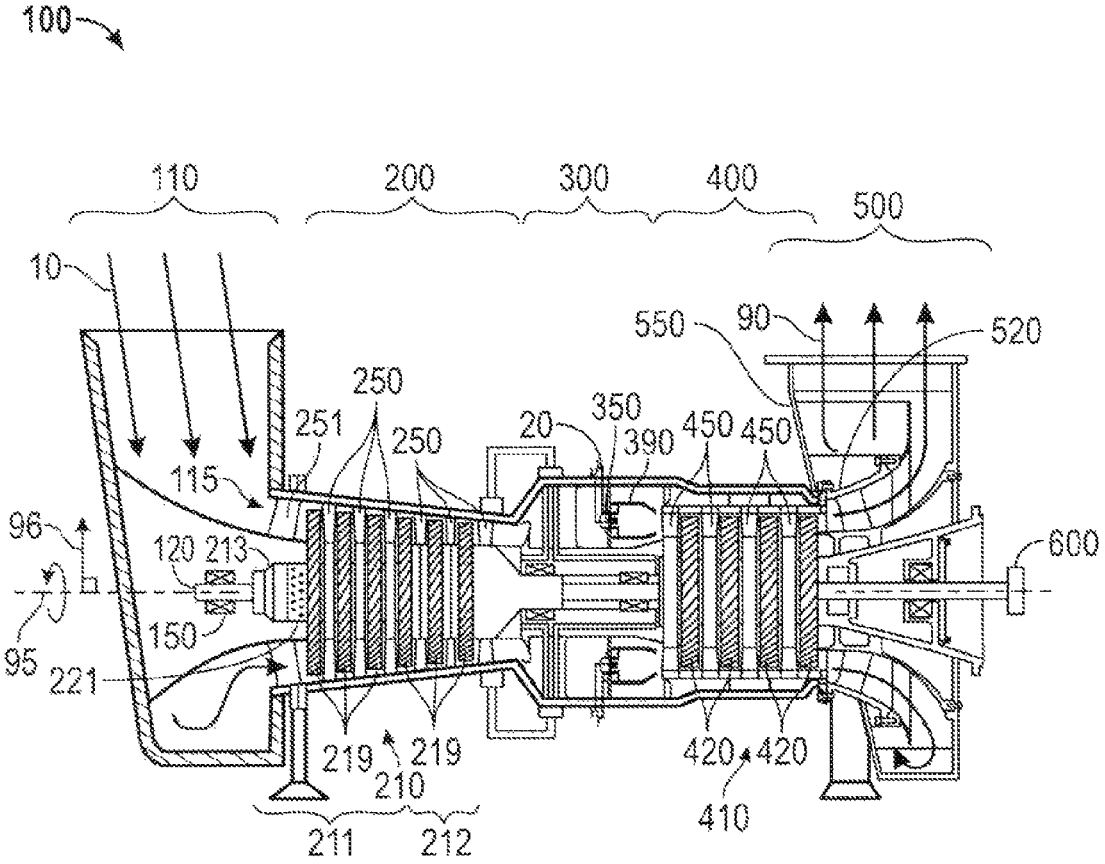
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (air which is used in the Brayton cycle, the thermodynamic basis for gas turbine operation), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a gas producer or "compressor" 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes ("stators") 250, and inlet guide vanes 251. The compressor rotor assembly 210 mechanically couples to shaft 120. As illustrated, the compressor rotor assembly 210 is an axial flow rotor assembly. The compressor rotor assembly 210 may include a forward weldment 211 and an aft weldment 212. The forward weldment 211 and the aft weldment 212 each include one or more compressor disk assemblies 219. Each compressor disk assembly 219 includes a compressor rotor disk 220 (shown in FIGS. 2, 3, and 4) that is circumferentially populated with compressor rotor blades. The forward weldment may also include the first stage compressor disk 221, which may be coupled to the forward hub 213.

Stators 250 axially follow each of the compressor disk assemblies 219. Each compressor disk assembly 219 paired with the adjacent stators 250 that follow the compressor disk assembly 219 is considered a compressor stage. Compressor 200 includes multiple compressor stages. Inlet guide vanes 251 axially precede the first compressor stage.

The combustor 300 includes one or more injectors 350 and includes one or more combustion chambers 390.

The turbine 400 includes a turbine rotor assembly 410 and turbine nozzles 450. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. Turbine nozzles 450 axially precede each of the turbine disk assemblies 420. Each turbine disk assembly 420 paired with the adjacent turbine nozzles 450 that precede the turbine disk assembly 420 is considered a turbine stage. Turbine 400 includes multiple turbine stages.

The exhaust 500 includes an exhaust diffuser 520 and an exhaust collector 550.

Figure 2:
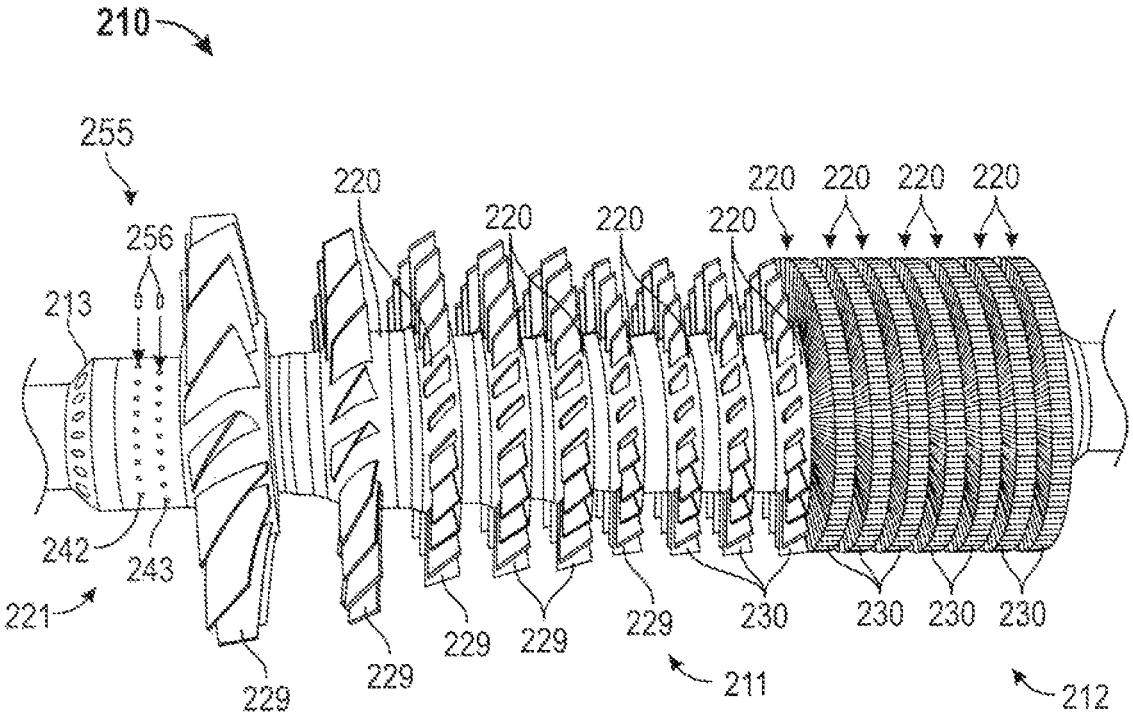
FIG. 2 is a perspective view of the compressor rotor assembly of the gas turbine engine of FIG. 1.

FIG. 2 is a perspective view of the compressor rotor assembly 210 of FIG. 1. The compressor rotor assembly 210 may include a balancing system. The balancing system may include a forward balancing system 255, compressor rotor blades, and underplatform weights 260 (shown in FIGS. 5-7).

Forward balancing system 255 includes multiple forward balancing holes 242, multiple ah balancing holes 243, and forward weights 256. A first group of balancing holes may be selected from the forward balancing holes 242 and the aft balancing holes 243. The remaining forward balancing holes 242 and aft balancing holes 243 may comprise a second group of balancing holes. Alternatively, the forward balancing holes 242 may comprise the first group of balancing holes and the aft balancing holes 243 may comprise the second group of balancing holes.

Forward weights 256 may have various sizes, masses, and lengths. In one embodiment forward weights 256 have a ⅜ inch diameter and lengths of ¼ inch, ½ inch, or ¾ inch. Alternatively, other diameters may be used.

Compressor rotor blades may be axially installed compressor rotor blades ("axial blades") 229 or circumferentially installed compressor rotor blades ("circumferential blades") 230. Compressor rotor blade sizes may be determined by the sizes of the compressor disks 220.

Figure 3:
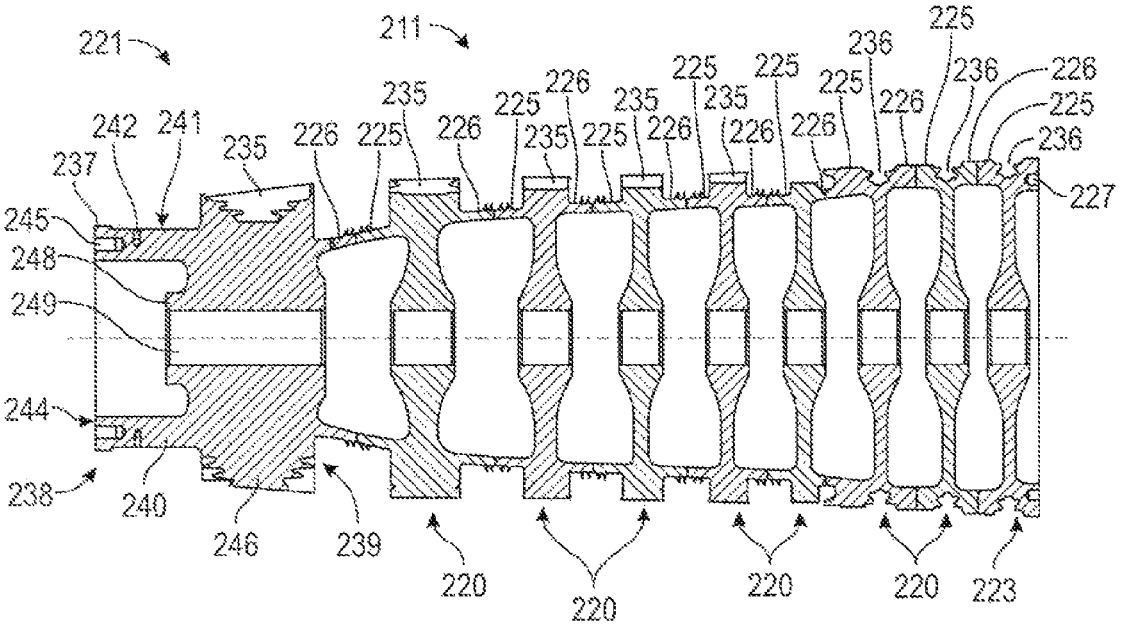
FIG. 3 is a cross-sectional view of the forward weldment of the compressor rotor assembly of FIG. 2.

FIG. 3 is a cross-sectional view of the forward weldment 211 of the compressor rotor assembly 210 of FIG. 2. The forward weldment 211 includes multiple compressor disks 220 including the first stage compressor disk 221 and the forward fastening compressor disk 223. The first stage compressor disk 221 may be located at the forward end of forward weldment 211. The first stage compressor disk 221 may have a cylindrical body 240 and may include a forward end 238, an aft end 239, an outer axial flange 237, and an outer surface 241. The outer axial flange 237 may extend axially forward from the cylindrical body 240. The outer surface 241 may extend from the forward end 238 towards the aft end. A portion of the outer surface 241 may be on the outer axial flange 237.

Radial flange 246 may extend radially outward from the cylindrical body 240. Radial flange 246 may include axial slots 235 configured for mounting axial blades 229 (shown in FIG. 2) to the first stage compressor disk 221. The axial slots 235 may have a fir tree or dovetail cross-sectional shape.

The first stage compressor disk 221 may also include forward balancing holes 242 and aft balancing holes 243. Each forward balancing hole 242 may extend radially inward through the outer surface 241. Forward balancing holes 242 may be aligned circumferentially and evenly spaced about outer surface 241. Each aft balancing hole 243 may extend radially inward through the outer surface 241. Aft balancing holes 243 may be aligned circumferentially and evenly spaced about outer surface 241. The aft balancing holes 243 may be adjacent to the forward balancing holes 242, may be axially aft of the forward balancing holes 242, and may be circumferentially offset or clocked relative to the forward balancing holes 242.

The forward balancing holes 242 and the aft balancing holes 243 may be located near the center of gravity of the first stage compressor disk 221. The aft balancing holes 243 may be closer to the center of gravity of the first stage compressor disk 221 than the forward balancing holes 242. The forward balancing holes 242 and the aft balancing holes 243 may be threaded. In one embodiment the holes have a ⅜ inch diameter. Alternatively, other diameters may be used.

The forward balancing holes 242 may total more man twelve and less than thirty. The aft balancing holes 243 may total more than twelve and less than thirty. The number of forward balancing holes 242 and aft balancing holes 243 may correspond with the diameter of outer surface 241 or may correspond with the number of axial slots 235 in the first stage compressor disk 221. The aft balancing holes 243 may be circumferentially offset or clocked by half of the angular distance between adjacent forward balancing holes 242. The depth of the forward balancing holes 242 and the aft balancing holes 243 may correspond with the size of the forward weights 256 of the forward balancing system 255.

In one embodiment the forward balancing holes 242 may total twenty-four, the aft balancing holes 243 may total twenty-four, and the aft balancing holes 243 may be circumferentially offset or clocked 7.5 degrees relative to the forward balancing holes 242. The aft balancing holes 243 may be shifted 1.5 inches axially aft of the forward balancing holes 242. In another embodiment the aft balancing holes 243 may be at least 0.75 inches deep.

The first stage compressor disk 221 may also include forward surface 244, hub mounting holes 245, and inner axial flange 248. Forward surface 244 may be the axially forward facing surface adjacent to the outer surface 241. Forward surface 244 may be on the outer axial flange 237. Hub mounting holes 245 may extend aft through the forward surface 244. In one embodiment, the hub mounting holes 245 are in the outer axial flange 237.

The inner axial flange 248 may extend axially forward from the forward end 238. The inner axial flange 248 may be located within the outer axial flange 237.

The first stage compressor disk 221 may also include an aft welding member 226. The aft welding member 226 may have an annular shape and may extend aft from the cylindrical body 240.

The first stage compressor disk 221 may further include a bore 249. The bore 249 may extend from the inner axial flange 248 at the forward end 238, to the aft end 239. The shaft 120 may pass through the bore 249 of the first stage compressor disk 221.

The forward fastening compressor disk 223 may be located at the aft end of forward weldment 211. The forward fastening compressor disk 223 may include a forward welding member 225 and forward weldment mounting holes 227. The forward welding member 225 may have an annular shape and may extend forward from the forward fastening compressor disk 223. The forward weldment mounting holes 227 may be located on an aft end of the forward fastening compressor disk 223 and may extend axially forward. In the embodiment shown in FIG. 3, forward fastening compressor disk 223 also includes a circumferential slot 236 for mounting circumferential blades 230 to forward fastening compressor disk 223. Circumferential slot 236 extends completely around forward fastening compressor disk 223. Circumferential slot 236 may have a fir tree or a dovetail shape.

The compressor disks 220 not located at the forward or aft end of the forward weldment may include a forward welding member 225 and an aft welding member 226. The forward welding member 225 may have an annular shape and may extend forward from the compressor disk 220. The aft welding member 226 may have an annular shape and may extend aft from the compressor disk 220. The aft welding member 226 of the first stage compressor disk 221 may be welded to the forward welding member 225 of the subsequent compressor disk 220. Each subsequent compressor disk 220 may be welded to the previous compressor disk 220 in a similar manner. The forward fastening compressor disk 223 may also be welded to the previous compressor disk 220 in a similar manner. In one embodiment the forward weldment 211 may include nine compressor disks 220; the forward fastening compressor disk 223 may be the ninth stage compressor disk.

Figure 5:
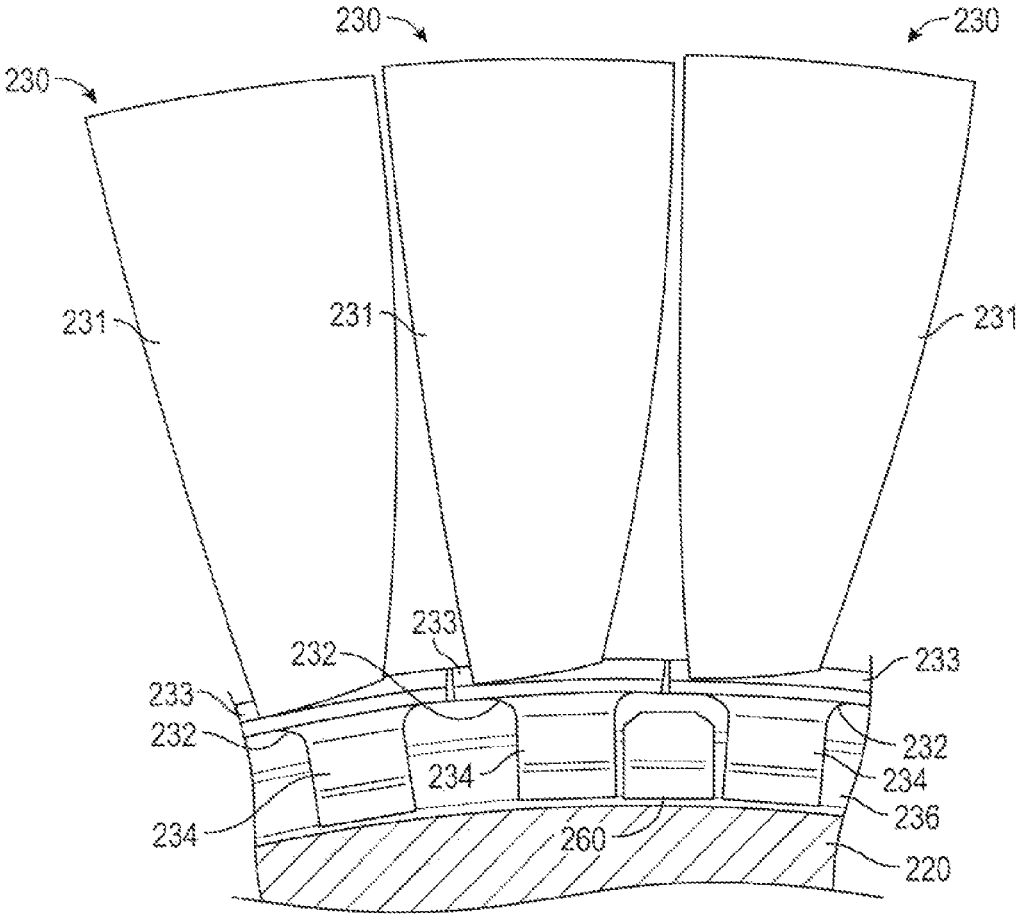
FIG. 5 is a perspective view of a portion of the compressor rotor assembly of FIG. 2 with circumferentially installed compressor rotor blades, an exemplary underplatform weight, and a compressor disk with a portion of the compressor disk cutaway to show the roots of the compressor rotor blades and the underplatform weight.

Each compressor disk 220 of forward weldment 211 may include multiple axial slots 235 or a circumferential slot 236. If the compressor disk 220 includes axial slots 235, one axial blade 229 may be inserted into each axial slot 235. If the compressor disk 220 includes a circumferential slot 236, multiple circumferential blades may be inserted into the circumferential slot 236. Underplatform weights 260 may be inserted into circumferential slot 236 between circumferential blades 230 (as shown in FIG. 5). In the embodiment shown in FIG. 3, the first six compressor disks 220 include axial slots 235, while the seventh, eighth, and ninth compressor disks 220 each include a circumferential slot 236.

Figure 4:
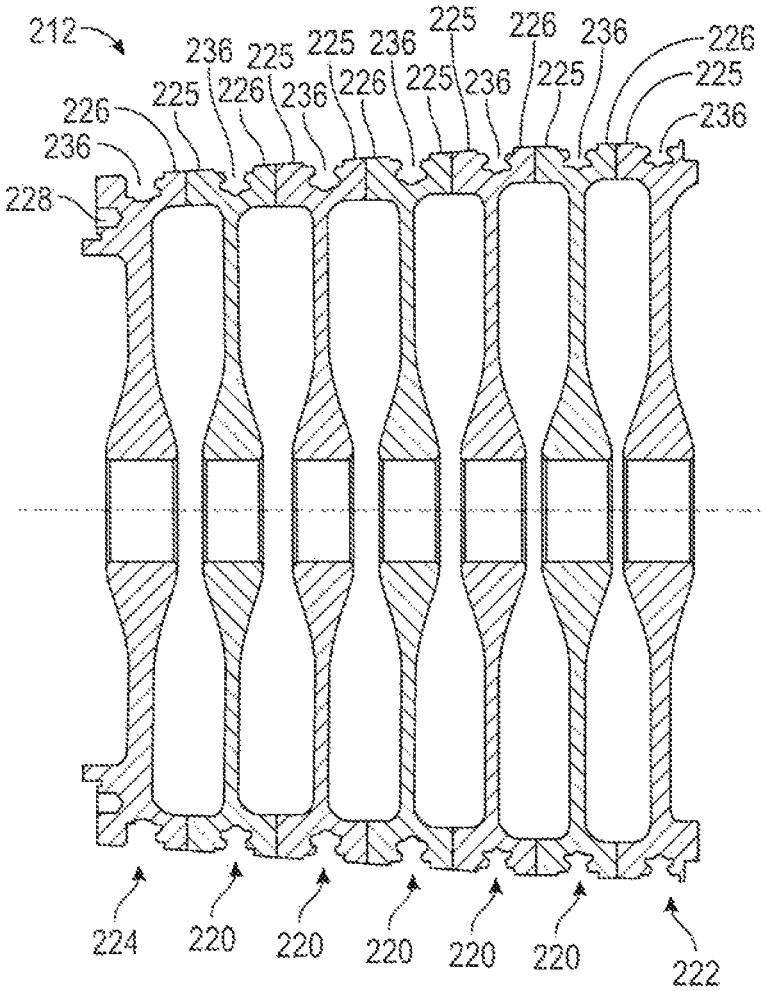
FIG. 4 is a cross-sectional view of the aft weldment of the compressor rotor assembly of FIG. 2.

FIG. 4 is a cross-sectional view of the aft weldment 212 of the compressor rotor assembly of FIG. 2. The aft weldment 212 may include multiple compressor disks 220 including the last stage compressor disk 222 and the aft fastening compressor disk 224. The aft fastening compressor disk 224 may include an aft welding member 226 and aft weldment mounting holes 228. The aft welding member 226 may have an annular shape and may extend aft from the aft fastening compressor disk 224. The aft weldment mounting holes 228 may be located on a forward end of the aft fastening compressor disk 224 and may extend axially aft.

The aft welding member 226 of the aft fastening compressor disk 224 may be welded to the forward welding member 225 of the subsequent compressor disk 220. Each subsequent compressor disk 220 may be welded to the previous compressor disk 220 in a similar manner. The last stage compressor disk 222 may also be welded to the previous compressor disk 220 in a similar manner. In one embodiment the aft weldment 212 may include seven compressor disks 220. In the embodiment shown in FIG. 4, the aft fastening compressor disk 224 is the tenth stage compressor disk and the last stage compressor disk 222 is the sixteenth stage compressor disk.

Each compressor disk 220 of aft weldment 212 may include multiple axial slots 235 or a circumferential slot 236. If the compressor disk 220 includes axial slots 235, one axial blade 229 may be inserted into each axial slot 235. If the compressor disk 220 includes a circumferential slot 236, multiple circumferential blades 230 may be inserted into the circumferential slot 236. Underplatform weights 260 may be inserted into circumferential slot 236 between circumferential blades 230 (as shown in FIG. 5). In the embodiment shown in FIG. 4, each aft weldment 212 compressor disk 220 includes a circumferential slot 236. Some circumferential slots 236 in forward weldment 211 and aft weldment 212 may have different dovetail or fir tree cross sections.

FIG. 5 is a perspective view of a portion of the compressor rotor assembly 210 of FIG. 2 with circumferential blades 230, an exemplary underplatform weight 260, and a compressor disk 220 with a portion of the compressor disk 220 cutaway to show the roots 234 of the circumferential blades 230 and the underplatform weight 260. Each circumferential blade 230 may include an airfoil 231 and a base 232. Each base 232 may include a platform 233 and a root 234. Platform 233 attaches to an end of airfoil 231. Root 234 extends from platform 233 in a direction opposite airfoil 231. Root 234 may have a dovetail or fir tree shape that matches the dovetail or fir tree shape of circumferential slot 236.

Each underplatform weight 260 is shaped to match the dovetail or fir tree shape of root 234. The shape of each underplatform weight 260 may also match the profile of a circumferential slot 236. The height of each underplatform weight 260 may be sized such that the top of the underplatform weight 260 does not contact platform 233. The width of each underplatform weight 260 may be sized to fit between adjacent circumferential blades 230. The width may be sized based on the tolerances of underplatform weight 260 and the root 234 of the circumferential blades 230 to ensure that underplatform weights 260 will fit between roots 234.

The width of each underplatform weight 260 may also be sized to avoid too much space between each underplatform weight 260 and the adjacent circumferential blade roots. Too much space may allow underplatform weights to shift and alter the balance of the compressor rotor assembly 210. Multiple underplatform weights 260 configurations and sizes may be used in the balancing system. For example, compressor disks 220 with circumferential slots may be divided into contiguous sections; each section includes one or more compressor disk 220. A different set of underplatform weights 260 may be provided for each section. One embodiment includes four sections. The first section includes one compressor disk. The second section is adjacent to and downstream of the first section and includes two adjacent compressor disks. The third section is adjacent to and downstream of the second section and includes four adjacent compressor disks. A fourth section is adjacent to and downstream of the third section and includes three adjacent compressor disks.

In the embodiment shown in FIGS. 2, 3, and 4, first underplatform weights are used for the first section. The first section includes the seventh stage compressor disk. Second underplatform weights are used for the second section. The second section includes the eighth and ninth stage compressor disks. Third underplatform weights are used for the third section. The third section includes the tenth through the thirteenth stage compressor disks. Fourth underplatform weights are used for the fourth section. The fourth section includes the fourteenth through the sixteenth stage compressor disks.

Figure 6:
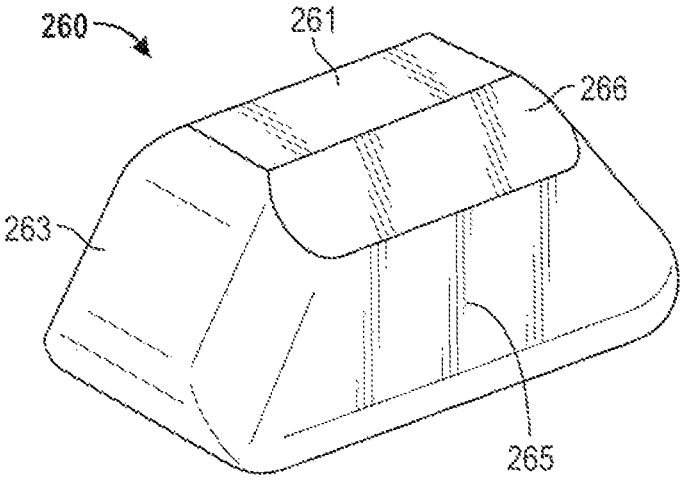
FIG. 6 is a perspective view of the underplatform weight of FIG. 5.
Figure 7:
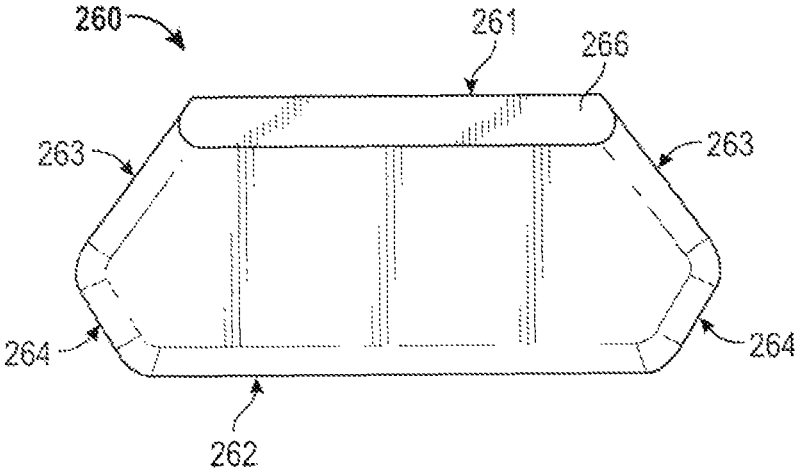
FIG. 7 is a side view of the underplatform weight of FIG. 5.

FIG. 6 is a perspective view of the underplatform weight 260 of FIG. 5. FIG. 7 is a side view of the underplatform weight 260 of FIG. 5. Referring to FIGS. 6 and 7, each underplatform weight 260 may include a top surface 261, a bottom surface 262, an upper face 263 at each end, a lower face 264 at each end, and two side surfaces 265. The cross-section or profile of the dovetail shape may be a convex hexagon with two parallel sides. In the embodiment shown in FIGS. 6 and 7, the top surface 261 and the bottom surface 262 are parallel and define the two parallel sides of the hexagonal shape. The surfaces defining the hexagonal shape may have different lengths. For example, in the embodiment shown top surface 261 is longer than upper face 263 and upper face 263 is longer than lower face 264.

Each upper face 263 may extend from an end of top surface 261 at an angle greater than 90 degrees and less than 180 degrees. Each lower face 264 may extend from an end of bottom surface 262 at an angle greater than 90 degrees and less than 180 degrees. The intersection of the upper face 263 and the lower face 264 at each end of each underplatform weight 260 may be at an angle between 90 degrees and 180 degrees. Side surfaces 265 extend from top surface 261 to bottom surface 262. Side surfaces 265 may be perpendicular to top surface 261 and bottom surface 262. Each end of underplatform weight 260 may be symmetrical.

The edges between surfaces and faces may be chamfered or rounded. In the embodiment shown in FIGS. 5, 6, and 7, the edges between top surface 261 and side surfaces 265 include a chamfer 266; the edges between upper face 263 and lower face 264, bottom surface 262 and lower face 264, and upper face 263 and side surfaces 265 are rounded.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 219. In particular, the air 10 is compressed in numbered "stages", the stages being associated with each compressor disk assembly 219. For example, "4th stage air" may be associated with the 4th compressor disk assembly 219 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel 20 is added. Air 10 and fuel 20 are injected into the combustion chamber 390 via injector 350 and combusted. Energy is extracted from the combustion reaction via the turbine 400 by each stage of the series of turbine disk assemblies 420. Exhaust gas 90 may then be diffused in exhaust diffuser 520, collected and redirected. Exhaust gas 90 exits the system via an exhaust collector 550 and may be further processed (e.g., to reduce harmful emissions, and/or to recover heat from the exhaust gas 90).

Gas turbine engines and other rotary machines include a number of rotating elements. An imbalanced rotating element may cause vibration when rotating. Vibration in a rotating element may cause undesirable stresses in the rotating element. The stresses caused by the vibration may cause a fatigue failure in the rotating element or other related elements. Excessive vibration in a gas turbine engine may reduce reliability, may cause high bearing loads, and may lead to component failures. In a gas turbine engine excessive vibration may also cause the shaft to bend or suffer from fatigue failure.

Through research and testing it was determined that some larger gas turbine engines may need to include a more complex balancing system and method. A gas turbine compressor rotor assembly may be balanced with weights near the forward end, near the aft end and near the mid-plane of compressor assemblies. Due to the length of larger assemblies, more balancing locations may be needed to balance a larger assembly within a desired standard.

A suitable balancing method may be accomplished by increasing the number of balancing locations, while limiting the number of components used in the balancing system. The balancing system disclosed herein may increase the number of balancing locations by making underplatform weights 260 available for each compressor disk 220 with a circumferential slot 236, and by providing forward balancing holes 242 and aft balancing holes 243 for forward weights 256. Increasing the number of balancing locations may reduce the difficulty of balancing the forward weldment 211, the aft weldment 212, and the compressor rotor assembly 210 by providing more balancing options. The balancing system disclosed herein may limit the number of components used in the balancing system by using the same underplatform weights 260 in mom than one axial location or stage. Limiting the number of components in the balancing system may limit or reduce the complexity of the balancing system. Reduced complexity and reduced difficulty of a balancing system may reduce the balancing time and may increase the accuracy of the balancing system.

In the embodiment shown in FIGS. 2, 3, and 4 the number of axial balancing locations totals twelve. This includes forward balancing holes 242, aft balancing holes 243, and compressor disks 220 in contiguous stages, stages seven through sixteen. However, the number of different components used in the embodiment shown in FIGS. 2, 3, and 4 may be as low as five. This includes forward weights 256, underplatform weights 260 for the stage seven compressor disk 220, underplatform weights 260 for the compressor disks 220 in stages eight and nine, underplatform weights 260 for the compressor disks 220 in stages ten through thirteen, and underplatform weights 260 for the compressor disks 220 in stages fourteen through sixteen. This number may slightly increase if multiple sized forward weights 256 are used.

The balancing system disclosed herein may reduce the imbalance of the gas turbine engine leading to less vibration and more trouble-free operation. In particular, it was determined that the balancing system including the forward balancing system 255 and underplatform weights 260 may reduce vibration and may increase the reliability of the compressor rotor assembly 230, the shaft 120, and the associated bearings among other components.

Through research and development the location of the forward balancing holes 242 and the aft balancing holes 243 were determined. Misplacement of the forward balancing holes 242 and the aft balancing holes 243 may reduce the fatigue strength of the first stage compressor disk 221 and may reduce the overall reliability of the first stage compressor disk 221. Variations in the cross-section throughout the first stage compressor disk 221, such as variations resulting from the forward balancing holes 242 and aft balancing holes 243, may lead to stress concentrations. These stress concentrations may cause cracking in the first stage compressor disk 221.

Figure 8:
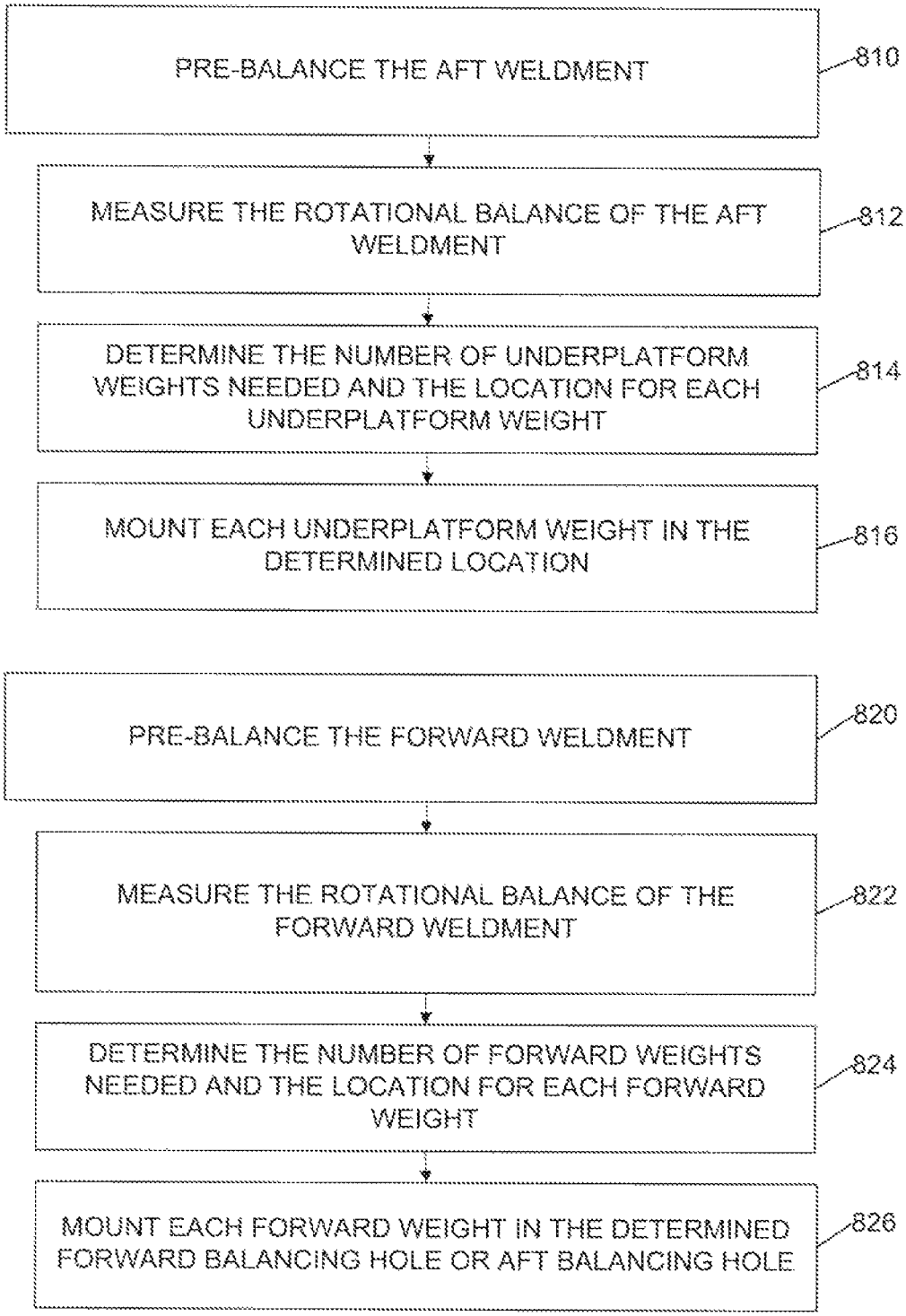
FIG. 8 is a flowchart of a method for balancing a gas turbine engine compressor rotor assembly, which includes pre-balancing the aft weldment and pre-balancing the forward weldment.

FIG. 8 is a flowchart of a method for balancing the compressor rotor assembly 210, which includes pre-balancing the aft weldment 212 at step 810 and may include pre-balancing the forward weldment 211 at step 820. Balancing the compressor rotor assembly 210 may include the balancing system disclosed herein, which may include the embodiment shown in FIGS. 2, 3, and 4.

Pre-balancing the aft weldment 212 includes measuring the rotational balance of the aft weldment 212 at step 812. Step 812 is followed by determining the number of underplatform weights 260 needed and the location for each underplatform weight 260 within a circumferential slot 236 of one the circumferentially loaded compressor disks 220 of the aft weldment 212 at step 814. Step 814 is followed by mounting each underplatform weight 260 at the determined location at step 816. Pre-balancing the aft weldment 212 occurs prior to joining the aft weldment 212 to the forward weldment 211. Pre-balancing the aft weldment 212 also occurs prior to populating the aft weldment with compressor rotor blades.

Pre-balancing the forward weldment 211 includes measuring the rotational balance of the forward weldment at step 822. Step 822 is followed by determining the number of forward weights 256 needed and the location for each forward weight 256 at step 824. Step 824 is followed by mounting each forward weight 256 in the determined forward balancing hole 242 or aft balancing hole 243 at step 826.

Pre-Balancing the forward weldment 211 may also include balancing the first stage compressor disk 221 prior to the first stage compressor disk 221 being welded to forward weldment 211. Balancing the first stage compressor disk 221 may include measuring the rotational balance of the first stage compressor disk 221. Measuring the rotational balance of the first stage compressor disk 221 may be followed by determining the number of forward weights 256 needed and the location for each forward weight 256. The location for each forward weight 256 may be in a forward balancing hole 242 or in an aft balancing hole 243. Balancing the first stage compressor disk 221 may also include mounting each forward weight 256 in the determined location.

Figure 9:
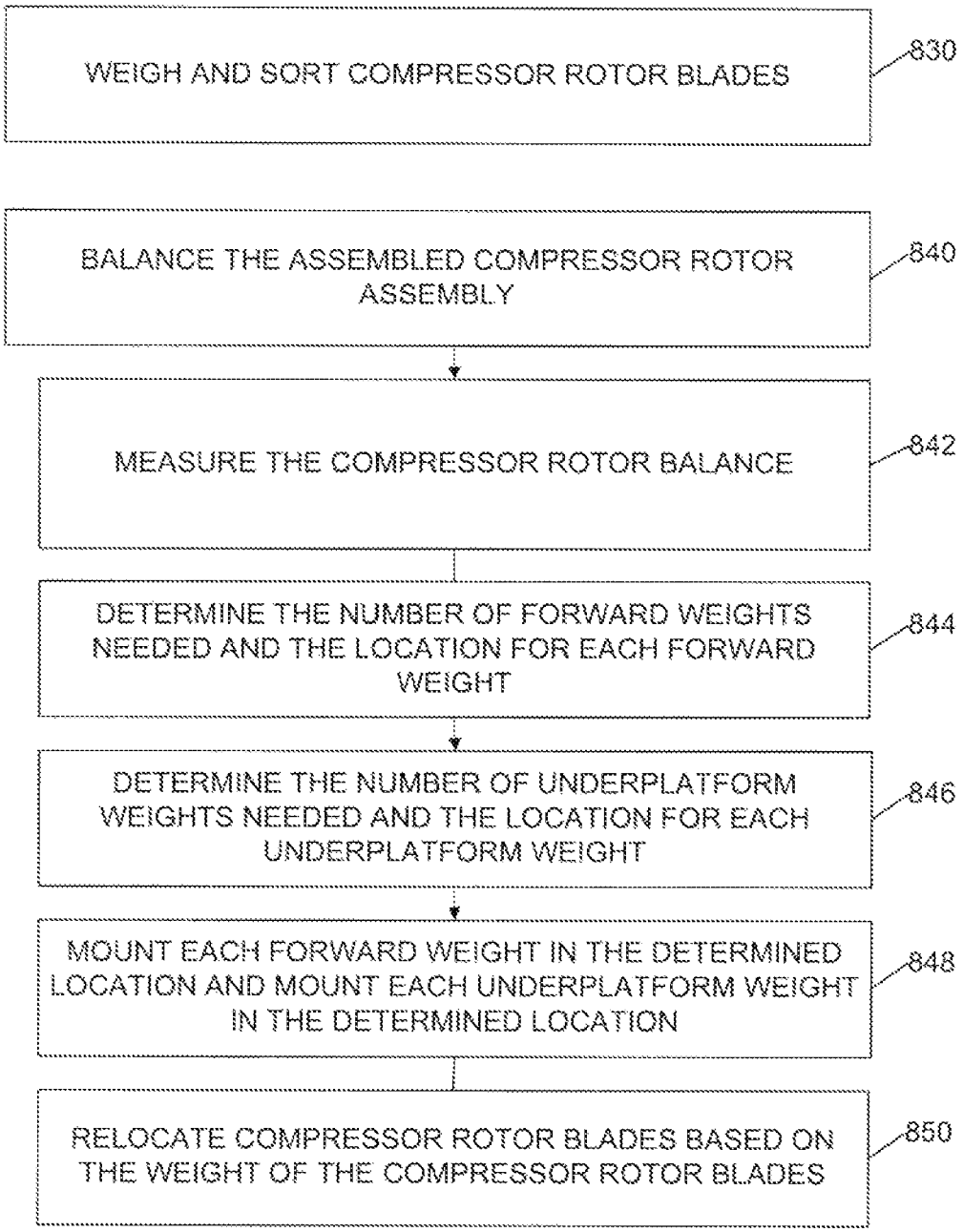
FIG. 9 is a flowchart of methods for balancing a gas turbine engine compressor rotor assembly, which includes balancing the assembled compressor rotor assembly.

The method for balancing the compressor rotor assembly 210 may also include balancing the assembled compressor rotor assembly at step 840. The assembled compressor rotor assembly including the forward weldment and the aft weldment coupled together, and compressor rotor blades mounted to the forward weldment and the aft weldment. FIG. 9 is a flowchart of a method for balancing the assembled compressor rotor assembly. Balancing the assembled compressor rotor assembly 210 includes measuring the compressor rotor balance at step 842. Step 842 is followed by determining the number of forward weights 256 needed and the location for each forward weight 256 at step 844. Step 842 is also followed by determining the number of underplatform weights 260 needed and the location for each underplatform weight 260 within a circumferential slot 236 of one the circumferentially loaded compressor disks 220 at step 846. The underplatform weight 260 mounting locations may be at any circumferentially loaded compressor disk 220 rather than just at the circumferentially loaded compressor disks 220 located at the midplane and at the aft plane of the compressor rotor assembly 210. The location of each underplatform weight 260 may determine which underplatform weight 260 is used, as the balancing system may use multiple underplatform weights 260.

Steps 844 and 846 are followed by mounting each forward weight 256 in the determined forward balancing hole 242 or aft balancing hole 243, and mounting each underplatform weight 260 at the determined location within the circumferential slots 236 at step 848.

Balancing the assembled compressor assembly is performed after assembly of the compressor rotor assembly 210 including joining the forward weldment 211 to the aft weldment 212, and mounting the compressor rotor blades to the forward weldment 211 and the aft weldment 212. Compressor rotor blades may be weighed and sorted prior to mounting the compressor rotor blades at step 830. Balancing the assembled compressor assembly may be performed before or after the gas turbine engine 100 is operated and tested. Balancing the assembled compressor assembly before testing the gas turbine engine 100 may be considered a shop balance, while balancing the assembled compressor assembly after testing may be considered a trim balance.

Steps 844 and 846 may also be followed by relocating compressor rotor blades based on the weight of the compressor rotor blades at step 850. Step 850 may be limited to relocating the axial blades 229 of first stage compressor disk 221 and the second stage compressor disk. The axial blades 229 of the first two compressor stages may be the largest compressor rotor blades. These axial blades 229 may have a greater effect on the imbalance of the compressor rotor assembly 210.

In some embodiments of the disclosed method, ¼ inch, ½ inch, or ¾ inch forward weights 256 are used in the aft balancing holes 243, and ¼ inch or ½ inch forward weights 256 are used in the forward balancing holes 242. In one embodiment, only the aft balancing holes 243 are used to pre-balance the first stage compressor disk 221.

It is understood that the steps disclosed herein (or parts thereof) may be performed in the order presented or out of the order presented, unless specified otherwise. For example, pre-balancing the aft weldment 212 at step 810 may be performed prior to, after, or simultaneously to pre-balancing the forward weldment 211 at step 820.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular forward weldment, a particular aft weldment, particular forward weights, particular underplatform weights, and associated processes, it will be appreciated that other forward weldments, aft weldments, forward weights, underplatform weights and processes in accordance with this disclosure can be implemented in various other compressor rotor assemblies, configurations, and types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A method for balancing a compressor rotor assembly including a forward weldment and an aft weldment, the method comprising:

pre-balancing the aft weldment of the compressor rotor assembly with compressor disks prior to populating the compressor disks with circumferentially installed compressor rotor blades, the pre-balancing the aft weldment including measuring a rotational balance of the aft weldment, determining a number of underplatform weights needed and a location for each underplatform weight within a circumferential slot of one of the compressor disks, and mounting each underplatform weight in the determined location; and balancing the assembled compressor rotor assembly with the aft weldment joined to the forward weldment and a plurality of compressor rotor blades mounted to the forward weldment and the aft weldment, including measuring a rotational balance of the compressor rotor assembly, determining a number of forward weights needed and a location for each forward weight in either a forward balancing hole or an aft balancing hole of the forward weldment, determining a number of underplatform weights needed and a location for each underplatform weight within a circumferential slot of a compressor disk in either the forward weldment or the aft weldment, and mounting each forward weight in the determined forward balancing hole or aft balancing hole, and mounting each underplatform weight in the determined location.

2. The method of claim 1, further comprising:

pre-balancing the forward weldment of the compressor rotor assembly with compressor disks prior to populating the compressor disks with circumferentially loaded compressor rotor blades, the pre-balancing the forward weldment including measuring a rotational balance of the forward weldment, determining a number of forward weights needed and a location for each forward weight in either a forward balancing hole or an aft balancing hole of the forward weldment, and mounting each forward weight in the determined forward balancing hole or aft balancing hole.

3. The method of claim 1, further comprising:

pre-balancing the forward weldment prior to populating the compressor disks with circumferentially loaded compressor rotor blades, the pre-balancing the forward weldment including measuring a rotational balance of the forward weldment, determining a number of forward weights needed and a location for each forward weight in either the forward balancing hole or the aft balancing hole, and mounting each forward weight in the determined forward balancing hole or aft balancing hole.

4. The method of claim 1, wherein a shop balance is performed by balancing the assembled compressor rotor assembly prior to testing a gas turbine engine that includes the compressor rotor assembly.

5. The method of claim 1, wherein a trim balance is performed by balancing the assembled compressor rotor assembly after testing a gas turbine engine that includes the compressor rotor assembly.

6. The method of claim 4, wherein a trim balance is performed by balancing the assembled compressor rotor assembly after testing a gas turbine engine that includes the compressor rotor assembly.

7. The method of claim 1, wherein axially installed compressor rotor blades of a first and a second stage of the compressor rotor assembly are relocated based on a measured weight of the compressor rotor blades.

8. A compressor rotor assembly balanced according to the method of claim 1.

9. A gas turbine engine balanced according to the method of claim 1.

10. A compressor rotor assembly with a balancing system for a gas turbine engine, the compressor rotor assembly comprising:

a first stage compressor disk with a cylindrical body having a plurality of forward balancing holes disposed circumferentially about the cylindrical body, and a plurality of aft balancing holes disposed circumferentially about the cylindrical body and located adjacent to the plurality of forward balancing holes, the first stage compressor disk defining a plurality of axial slots for mounting first stage rotor blades to the first stage compressor disk, the plurality of forward balancing holes and the plurality of aft balancing holes being disposed upstream of the plurality of axial slots along a flow direction through the compressor rotor assembly;

a plurality of compressor disks, each compressor disk of the plurality of compressor disks having a circumferential slot, each circumferential slot including a dovetail profile;

forward weights configured to be installed in the plurality of forward balancing holes and the plurality of aft balancing holes; and a plurality of underplatform weights, each underplatform weight of the plurality of underplatform weights being configured for installation within a circumferential slot of the plurality of compressor disks, each underplatform weight having a dovetail shape corresponding to the dovetail profile of the circumferential slot of the plurality of compressor disks, the plurality of underplatform weights having two or more sizes.

11. The compressor rotor assembly of claim 10, wherein each underplatform weight includes a convex hexagonal shape with two parallel sides.

12. The compressor rotor assembly of claim 10, wherein the plurality of compressor disks includes a plurality of contiguous sections, each contiguous section of the plurality of contiguous sections including one or more compressor disks, and wherein underplatform weights of a different size are provided for each contiguous section.

13. The compressor rotor assembly of claim 12, wherein the plurality of compressor disks includes ten contiguous compressor disks, and wherein the plurality of contiguous sections includes a first section with one compressor disk, a second section adjacent to and downstream of the first section with two compressor disks, a third section, adjacent to and downstream of the second section with four compressor disks, and a fourth section adjacent to and downstream of the third section with three compressor disks.

14. The compressor rotor assembly of claim 10, wherein a number of the forward balancing holes totals between 12 and 30, a number of the aft balancing holes totals between 12 and 30, and the aft balancing holes are circumferentially offset from the forward balancing holes by half of an angular distance between adjacent forward balancing holes.

15. A gas turbine engine including the compressor rotor assembly of claim 10.

16. A compressor rotor assembly for a turbine engine, the compressor rotor assembly comprising:

a forward weldment having a first plurality of compressor disks including a first stage compressor disk with a cylindrical body, the cylindrical body defining a plurality of forward balancing holes circumferentially aligned about the cylindrical body, and a plurality of aft balancing holes circumferentially aligned about the cylindrical body adjacent to the plurality of forward balancing holes, each compressor disk of the first plurality of compressor disks including a plurality of axial slots;

a second plurality of compressor disks, each compressor disk of the second plurality of compressor disks including a circumferential slot;

an aft weldment fixedly attached to the forward weldment, the aft weldment having a third plurality of compressor disks, each compressor disk of the third plurality of compressor disks including a circumferential slot;

a plurality of compressor rotor blades having a plurality of axial blades and a plurality of circumferential blades, wherein each axial slot of the plurality of axial slots is configured to receive one axial blade of the plurality of axial blades, and wherein each circumferential blade of the plurality of circumferential blades includes a base including a platform and a root extending from the platform, and an airfoil extending from the platform in a direction opposite the root, wherein each circumferential slot is configured to receive multiple circumferential blades; and a balancing system having forward weights configured to be installed in the plurality of forward balancing holes and the plurality of aft balancing holes, and a plurality of underplatform weights, each underplatform weight of the plurality of underplatform weights being configured for installation within a circumferential slot of the of the second or third plurality of compressor disks between adjacent circumferential blade roots, each underplatform weight including a shape that matches a shape of the root of one blade of the plurality of circumferential blades.

17. The compressor rotor assembly of claim 16, wherein a combination of the first plurality of compressor disks, the second plurality of compressor disks, and the third plurality of compressor disks includes a plurality of contiguous sections including a first section with one compressor disk, a second section adjacent to and downstream of the first section with two adjacent compressor disks, a third section, adjacent to and downstream of the second section with four adjacent compressor disks, and a fourth section, adjacent to and downstream of the third section with three adjacent compressor disks, wherein a first plurality of underplatform weights is provided for the first section, a second plurality of underplatform weights is provided for the second section, a third plurality of underplatform weights is provided for the third section, and a fourth plurality of underplatform weights is provided for the fourth section.

18. The compressor rotor assembly of claim 16, wherein each underplatform weight includes a cross-section with a convex hexagonal shape with two parallel sides.

19. A gas turbine engine including the compressor rotor assembly of claim 16.

* * * * *